US009376830B1

(12) United States Patent
Watson, III

(10) Patent No.: US 9,376,830 B1
(45) Date of Patent: Jun. 28, 2016

(54) TOWER REINFORCEMENT APPARATUS AND METHODS

(71) Applicant: Thomas B. Watson, III, Santa Rosa Beach, FL (US)

(72) Inventor: Thomas B. Watson, III, Santa Rosa Beach, FL (US)

( * ) Notice: Subject to any disclaimer, the term of this patent is extended or adjusted under 35 U.S.C. 154(b) by 0 days.

(21) Appl. No.: 14/701,836

(22) Filed: May 1, 2015

(51) Int. Cl.

| | |
|---|---|
| ***E04H 12/10*** | (2006.01) |
| ***E04B 1/19*** | (2006.01) |
| ***E04B 1/41*** | (2006.01) |
| *E04B 1/38* | (2006.01) |
| *E04H 12/00* | (2006.01) |

(52) U.S. Cl.
CPC ..... *E04H 12/10* (2013.01); *E04B 1/1903* (2013.01); *E04B 1/40* (2013.01); *E04B 2001/1918* (2013.01); *E04B 2001/1963* (2013.01); *E04B 2001/1987* (2013.01); *E04B 2001/405* (2013.01); *E04H 2012/006* (2013.01)

(58) Field of Classification Search
CPC ... E04H 12/20; E04H 12/10; E04H 2012/006; Y10T 29/49627; Y10T 29/49623; Y10T 29/49625; E04B 1/1903; E04B 1/40; E04B 2001/1918; E04B 2001/1963; E04B 2001/1987; E04B 2001/405
USPC ..... 52/651.07, 651.08, 651.09, 652.1, 632, 52/146, 149, 150; 29/897.1, 897.3, 29/897.31, 897.312
See application file for complete search history.

(56) References Cited

U.S. PATENT DOCUMENTS

| | | | | |
|---|---|---|---|---|
| 1,658,535 | A | 2/1928 | Neilson | |
| 1,693,107 | A * | 11/1928 | Campbell | E21B 15/00 182/179.1 |
| 2,945,231 | A | 7/1960 | Scheldorf | |
| 3,360,288 | A * | 12/1967 | Holscher | E04H 12/10 52/637 |
| 3,371,458 | A * | 3/1968 | Sturgill | E04H 12/10 182/178.5 |
| 4,216,636 | A | 8/1980 | Cordell | |
| 6,935,025 | B1 | 8/2005 | Watson, III et al. | |
| 6,944,950 | B1 | 9/2005 | Watson, III et al. | |
| 8,534,026 | B2 * | 9/2013 | Bauman | E04C 3/32 52/223.4 |
| 2011/0107709 | A1 * | 5/2011 | Bauman | E04C 3/32 52/651.01 |

* cited by examiner

*Primary Examiner* — Brent W Herring
(74) *Attorney, Agent, or Firm* — Kenneth W. Float

(57) ABSTRACT

Apparatus and methods for reinforcing an existing tower assembly having existing leg members. Exemplary apparatus comprises a plurality of interior adjustable-length leg members that are secured to the existing leg members closer to an axial centerline of the tower assembly that are lengthened after securement. A plurality of brace members interconnect the interior leg members. Lengthening of the interior adjustable-length leg members transfer a portion of the load to the interior adjustable-length leg members and shift the compression load toward the axial centerline of the tower assembly.

15 Claims, 7 Drawing Sheets

TOWER REINFORCEMENT APPARATUS AND METHODS

BACKGROUND

The present invention relates generally to apparatus and methods for reinforcing existing tower structures interior.

Existing towers, including guy-wired or self-supporting towers for supporting communication devices and antennas, for example, may require reinforcing because they weaken over time or the desired to enable additional load-bearing capabilities of the tower. When the term "load" is used herein, it is understood to mean shear forces from wind and compression in addition to the weight that is supported by a structure. Typically, each tower has its own foundation and multiple legs which are spliced together at convenient intervals, with diagonal and horizontal cross-braces interspersed between the legs. The splice connections for each tower section typically are constructed in one of two ways. The first type of splice connection is accomplished using abutting flange plates having matching bolt hole placements. The second type of splice connection, used for those towers having tubular legs, incorporates a telescoping connection of the two tubular legs, where the end of one leg in cross-section is reduced so that it fits inside the corresponding leg in order that matching bolt holes can be aligned for connecting the two legs.

It would be desirable to have a way of increasing the structural integrity and capability of existing towers in lieu of replacing the towers entirely. Previous attempts to bolster existing tower structures have provided augmentation members which are installed on the existing tower legs. In such a structure, addition of such devices as antenna to the tower structure is impaired by the location of the augmentation of additional members attached to the existing tower legs. Thus, a need exists for apparatus and methods for reinforcing an existing tower structure that does not require structural modification such as field drilling or field welding to existing the tower legs and allows continued access to existing tower legs.

U.S. Pat. No. 1,658,535 issued to Neilson discloses a derrick wherein tension rods 29 having "hooked" or "eyed" ends (shown in FIG. 4) are used to connect the clamp brackets 8 to the base 32 and to an upper section 2' of the derrick. This is replicated throughout the entire length of the derrick. These tension rods 29 are discussed, for example, at page 2, line 21 and 45, and at page 3 lines 14, 27, 52, 65, 75, 77 and 105. The Neilson patent does not disclose or suggest apparatus or methods that provide for a reduction of the compression load on load-bearing sections of an existing lattice tower. The Neilson patent does not address this, because the leg members are held in tension by the tension rods with their hooked or eyed ends. There is no disclosure or suggestion contained in the Neilson patent that would address compression load reduction. There is also no disclosure or suggestion contained in the Neilson patent that would address reinforcing existing tower structures.

U.S. Pat. No. 4,216,636, issued Aug. 12, 1980, discloses a tower characterized by a rigid, self-supporting structure which includes a set of vertically oriented outside legs arranged in a generally triangular configuration and a set of vertically oriented inside legs also arranged in a generally triangular configuration and positioned adjacent the outside legs. This arrangement provides for coaxial inner and outer triangular-shaped support structures. The outside legs and inside legs are fitted with a plurality of generally horizontally disposed braces and are supported in spaced relationship by a plurality of triangular collars also oriented in generally horizontal and spaced relationship along the length of the tower. In a preferred embodiment the outside legs and inside legs are fastened to the triangular collars by means of flanges. The triangular collars are solid and secure all six inside and outside legs. The triangular collars are installed when constructing the coaxial tower structure, and there is no disclosure or suggestion that they could or should be added subsequent to construction. Also, nothing is disclosed or suggested in U.S. Pat. No. 4,216,636 regarding a triangular coaxial tower reinforcing structure that is added to an existing tower structure to reinforce it.

U.S. Pat. No. 2,945,231 issued to Scheldorf cited in the Background section of U.S. Pat. No. 4,216,636 discloses antenna tower having coaxial inner and outer support structures with triangular-shaped cross sections, as illustrated in FIG. 3. The inner structure is the primary structural member of the tower and the outer members characterize a suppressor structure. The legs of the tower are securely anchored in concrete for maximum rigidity and the triangular cross-sectional configuration of the structure insures maximum strength. However, nothing is disclosed or suggested in U.S. Pat. No. 2,945,231 regarding a tower reinforcing structure that is constructed and added to an existing tower structure to reinforce it.

Inventions that improve upon prior reinforcement techniques are disclosed in U.S. Pat. No. 6,935,025, issued Aug. 30, 2005, and U.S. Pat. No. 6,944,950, issued Sep. 20, 2005, for example. These patents discloses apparatus and methods for reinforcing at least one load-bearing section of an existing lattice tower assembly, which load-bearing section has a predetermined compression load.

Exemplary apparatus and methods disclosed in U.S. Pat. No. 6,935,025 provide for two leg members, and at least one brace member, sized and configured for connection to both of the leg members. At least one connecting plate is sized and configured for attachment to a respective flange plate of the section of the tower assembly and for attachment to an end of one of the leg members, which flange plate is attached to or integral with the section of the tower assembly. The leg members, the at least one brace member and at least one connecting plate are sized and configured for attachment to one another to form a structure or a plurality of structures, such that the two leg members bear at least a portion of the compression load when installed.

Transfer means transfers a portion of the compression load from the one or more load-bearing sections to the leg members so that the one or more load-bearing sections have a compression load that is lower than the predetermined compression load.

Exemplary apparatus and methods disclosed in U.S. Pat. No. 6,944,950, and illustrated in FIGS. 3, 8A and 8B, for example, provide for three pairs of outer reinforcing leg members comprising a plurality of connectable leg sections respectively located outside of, or exterior to, three existing leg members of the tower assembly. One reinforcing leg member from each pair is interconnected to a proximal reinforcing leg member of an adjacent pair using braces to form a load bearing structure. Threaded sleeve nuts and lock nuts axially interconnect adjacent ones of the connectable leg sections and are used to adjust the overall length of the associated leg member, and thus transfer a portion of the compression load from the load-bearing section to the outer leg members so that the load-bearing section has a compression load that is lower than the predetermined compression load. The compression load that is transferred to the outer legs is shifted away from the axial centerline of the tower assembly and toward the outside of the tower assembly.

The tower reinforcement apparatus disclosed in U.S. Pat. No. 6,944,950 adds additional legs and reinforcing structures to the exterior of the existing tower. Nothing is disclosed or suggested in U.S. Pat. No. 6,944,950 indicating the desirability, benefits, or usefulness of reinforcing leg members and reinforcing structures located inside the locations of existing tower legs, closer to the vertical center of the tower. However, towers can become highly loaded along their exterior edges, such as when additional or larger communication antennas are installed. This loading also may not be symmetrical. The present invention addresses the issue of exterior tower loading.

In addition, the vast majority (if not all) of the antennas and cables attached to the tower are affixed to the exterior of the tower, and reinforcing members placed on the exterior perimeter of the tower may be in physical conflict with the antennas and cables.

It would be desirable to improve upon the apparatus and methods disclosed in U.S. Pat. No. 6,944,950, for example, and other patented techniques, to reinforce antenna towers that are highly loaded on the exterior. It would be desirable to have reinforcement methods and apparatus that provide attachable structures that do not require welding or drilling. It would be desirable to have reinforcing methods and apparatus that, once installed, allows continued access to the existing tower legs so that later attachment of communication devices are not impeded. It would be desirable to have reinforcement methods and apparatus that accomplishes the reinforcement process completely on site, or allows partial offsite assembly in another location before final installation in the field. It would be desirable to have reinforcement methods and apparatus that would allow the original safety line attachments to remain place. It would also be desirable to have reinforcement methods and apparatus that address problems associated with exterior loading of towers. It would be desirable to have reinforcement methods and apparatus that shifts the compression loading toward the center of the tower.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

Figure 1:
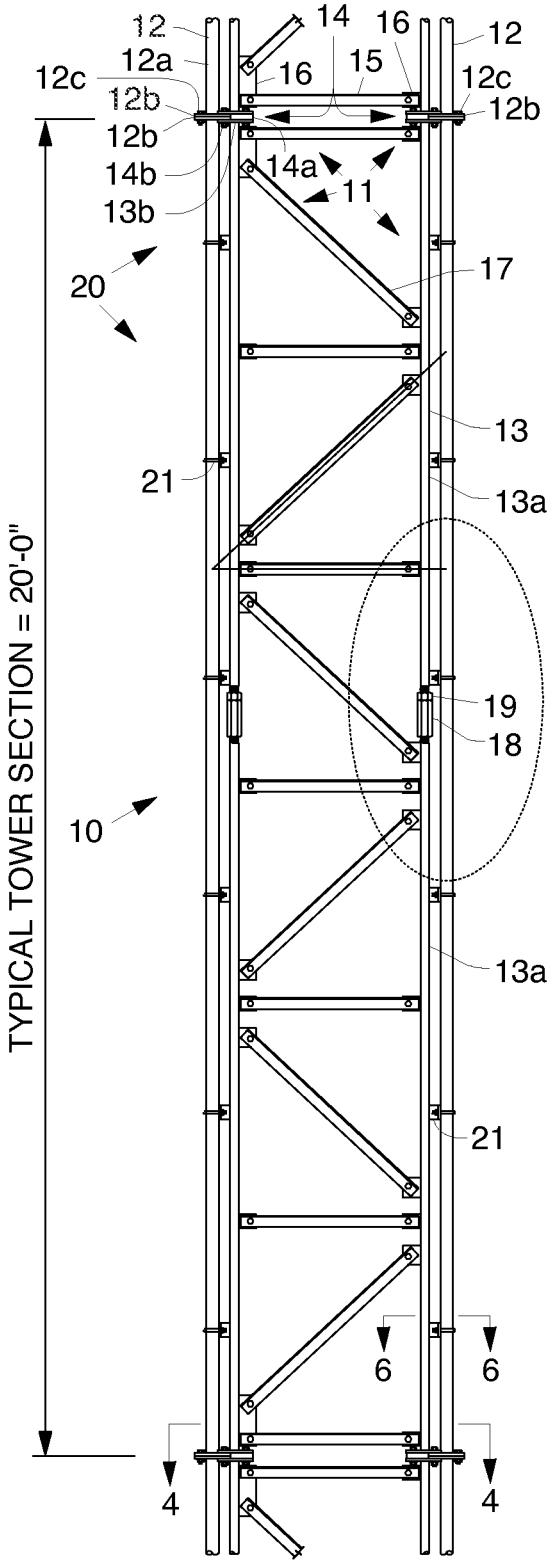
FIG. 1 is a side view of a portion of a tower reinforced by exemplary tower reinforcement apparatus.

Referring to the drawing figures, disclosed are reinforcing apparatus 11 and methods for reinforcing one or more load-bearing sections of a tower 10 or tower assembly 10, illustrated as a triangular guyed tower 10 or guyed tower assembly 10. The concept of the structural design of the reinforcing apparatus 11 is a structural system that strengthens existing guyed towers 10 and self-supporting towers 10 using axially-coupled (spliced) pairs of preferably solid round rods (referred to as interior adjustable-length leg members 13) that attach to existing exterior leg members 12 of the tower structure to provide for compression and tension resistance. Each coupled pair of adjustable-length leg members 13 are clamped to the existing towers legs 12 to provide lateral support. The clamped adjustable-length leg members 13 are interconnected by lateral braces 15, 17.

Installation of the reinforcing apparatus 11 requires no attachments to or augmentation of existing diagonal and/or horizontal braces of the tower 10 or welding to and/or drilling of the existing tower 10. Components of the reinforcing apparatus 11 are designed to implement a load path transfer technique and are attached to the existing tower 10 using bolted connections. Horizontal and diagonal (non-horizontal) braces 15, 17 interconnecting the coupled pair of interior adjustable-length leg members 13 (solid rods) are placed on horizontal and diagonal centerlines that are substantially the same as the horizontal and diagonal braces of the existing tower 10 to provide wind shielding of the components of the reinforcing apparatus 11 and thus minimize additional wind loading on the tower 10. Thus, adjacent existing interior horizontal and diagonal (non-horizontal) braces 15, 17 are laterally coplanar, so that lateral winds hitting existing braces, for example, are prevented from directly hitting adjacent interior braces 15, 17 protected by the existing braces, and vice versa, so that additional wind loading is not exerted on the tower 10.

The existing leg members 12 of the tower assembly 10 are located at outside corners of the tower assembly 10, which are referred to as exterior leg members 12. The exterior leg members 12 are interconnected in a conventional manner using horizontal and diagonal braces 12*d* (FIG. 4), for example, which reinforce the tower assembly 10.

Exemplary tower reinforcing apparatus 11 comprises a plurality of interior adjustable-length leg members 13 that are installed inside the respective exterior leg members 12. Each or the interior adjustable-length leg members 13 comprise a plurality of leg sections 13*a*. Proximal ends of adjacent axially-separated leg sections 13*a* have left and right handed male threads, respectively, at their proximal ends. Adjacent leg sections 13*a* are axially connected using splice connection members 18 and locking members 19, such as sleeve nuts 18 and locking nuts 19, or the like. Each of the interior adjustable-length leg members 13 is positioned adjacent to a corresponding one of the exterior leg members 12 closer to the vertical centerline of the antenna tower 10. A plurality of connection members 14, connection plates 14, or splice connection plates 14, are provided for connecting or attaching each interior adjustable-length leg member 13 to the adjacent exterior leg member 12.

Although solid round rods are preferably employed as the interior adjustable-length leg members 13, other rod cross sectional shapes may be employed as long as ends of the interior adjustable-length leg members 13 are appropriately threaded, for example, to allow axial connection to an adjacent interior adjustable-length leg member 13.

A plurality of horizontal brace members 15 cross-connect adjacent interior adjustable-length leg members 13, using bracing clips 16 attached by welding or otherwise to the interior adjustable-length leg members 13 along with bolts and nuts used to secure the horizontal brace members 15 to the bracing clips 16, for example. Non-horizontal (diagonal) brace members 17 also cross-connect adjacent interior adjustable-length leg members 13 using bracing clips 16, along with nuts and bolts, for example. Exemplary non-horizontal brace members 17 include diagonal (shown in the drawing figures), or any cross sectional shape and may be varied cross-sectional shape throughout the height of the reinforced sections.

The interconnected interior adjustable-length leg members 13 and brace members 15, 17 form an interior load-bearing structure 20. The interior adjustable-length leg members 13 and interior structures 20 are sized and configured to bear at least a portion of the compression load of the tower when the interior leg members 13 and brace members 15, 17 (i.e., interior structures 20) are installed. A portion of the compression load is transferred to the interior adjustable-length leg members 13 by selectively adjusting lengths of the respective interior adjustable-length leg members 13 using the splice connection members 18 so that the structures 20 are longer than the length of the exterior leg members 12 measured between distal ends of adjacent connection members 14, which is the length of a corresponding load-bearing section. This may be achieved by appropriately rotating the respective sleeve nuts 18 to achieve a desired length, and then fixing the lengths of the respective interior leg members 13, and thus its length, such as by tightening the locking members 19 or nuts 19. The desired amount of load transfer is achieved by lengthening the interior adjustable-length leg members 13 which shifts the predetermined compression load toward the axial centerline of the tower assembly 10 and transfers at least a portion of the section load onto each of the interior adjustable-length leg member 13.

The intended use of the reinforcing apparatus 11 is to strengthen existing guyed towers and self-supporting towers 10 by using left and right handed male threads, respectively, on adjacent axially-separated ends of a pair of solid round rods (i.e., the interior leg sections 13*a*) and coupled with a sleeve nut 18 that has left and right handed female threads. The sleeve nut 18 is used to increase the length of the coupled pair of interior leg sections 13*a* and thus increase the length of the interior leg 13. After the coupled pair of solid interior leg sections 13*a* are in place, the sleeve nut 18 is rotated to impose compression on the coupled pair of interior leg sections 13*a* which reduces the amount of compression on the existing adjacent tower leg 12. By placing the coupled pair of interior leg sections 13*a* adjacent to the existing tower leg 12 and rotating the sleeve nut 18 so as to impose compression on the coupled pair of interior leg sections 13*a*, compressive load on the existing tower leg 12 is transferred to the coupled pair of interior leg sections 13*a*. This is the load path transfer technique used in the present invention.

The interior leg sections 13*a* are compression and/or tension members made of a metallic material with a cross section that is solid and round. The diagonal and/or horizontal brace members 15, 17 are compression and/or tension members made of a metallic material having a cross section that may be solid or hollow, round or square, L-shaped, or any other shape that is deemed appropriate for a specific design.

Because there are a variety of possible designs of the connection members 14 (splice plates 14) in both guyed towers 10 and self-supporting towers 10, the splice connection members 14 used to implement the load path transfer technique are custom designed for each specific tower 10. For each splice connection, there is a spacer plate 14*a* and upper and lower splice plates 13*b* that are fabricated into shapes that have a cutout to allow the existing tower leg 12 to pass by the splice connection members 14 that implement the load path transfer technique.

The lateral support clamp 21 is used to fasten the coupled pair of interior leg sections 13*a* (solid round rods) to the existing tower legs 12 to reduce the slenderness ratio of both the coupled pair of interior leg sections 13*a* (solid round rods) and the existing tower legs 12 which will help prevent buckling.

The transfer of compression load to the interior adjustable-length leg members 13 relieves compression loading on the existing exterior leg members 12, so that the exterior leg members 12 have a greater capacity to resist additional compression due to wind load, for example.

The tower reinforcing apparatus 11 does not require use of thrust plates and bolts to transfer a portion of the compression load from the exterior leg members 12 to the interior adjustable-length leg members 13 as is used in the apparatus disclosed in U.S. Pat. Nos. 6,935,025 and 6,944,950, for example. Furthermore, the tower reinforcing apparatus 11 does not employ leg members that are outside of the existing (exterior) leg members 12 of the tower assembly 10 as is disclosed in U.S. Pat. Nos. 6,935,025 and 6,944,950.

Additionally, there are several advantages resulting from placing three coupled pairs of solid round rods (pairs of interior adjustable-length leg members 13) on the inside of the tower assembly 10 (i.e., inside the existing exterior leg members 12) rather than placing six coupled pairs of solid round rods (legs) on the outside of the tower assembly 10 as is disclosed in U.S. Pat. No. 6,944,950. These advantages are that (1) the vast majority (if not all) of the antennas and cables attached to the tower assembly 10 are affixed to the exterior of the tower assembly 10 and reinforcing members placed on the exterior perimeter of the tower assembly 10 are in physical conflict with the antennas and cables.

More particularly, and with regard to wind profile area, by placing the three adjustable-length leg members closer to an axial centerline of the tower rather than the six leg members labeled 12A and 12B in FIGS. 1, 8A and 8B disclosed in U.S. Pat. No. 6,944,950 reduces the effective projected area which results in a lower wind drag factor (see "Structural Standard for Antenna Supporting Structures and Antennas," TIA-222-G, Section 2.6.1). By using one adjustable-length leg member 13 placed adjacent to each existing tower leg 12 verses two adjustable-length leg members placed adjacent to each existing tower leg as shown in U.S. Pat. No. 6,944,950 prevents the possibility of asymmetrical loading from the two adjustable-length leg members which could produce a twisting effect about the horizontal axis at each splice plate connection member 14. Finally, by placing the three adjustable-length leg members 13 closer to an axial centerline of the tower assembly 12 rather than six leg members 12A, 12*b* on the exterior of the tower in FIGS. 1, 8A and 8B, for example, disclosed in U.S. Pat. No. 6,944,950, eliminates the need for a safety cable or rigid rail to be removed and relocated because all of the tower reinforce members are located on the interior of the existing tower 10 (see "Structural Standard for Antenna Supporting Structures and Antennas," TIA-222-G, Section 12.2).

Figure 2:
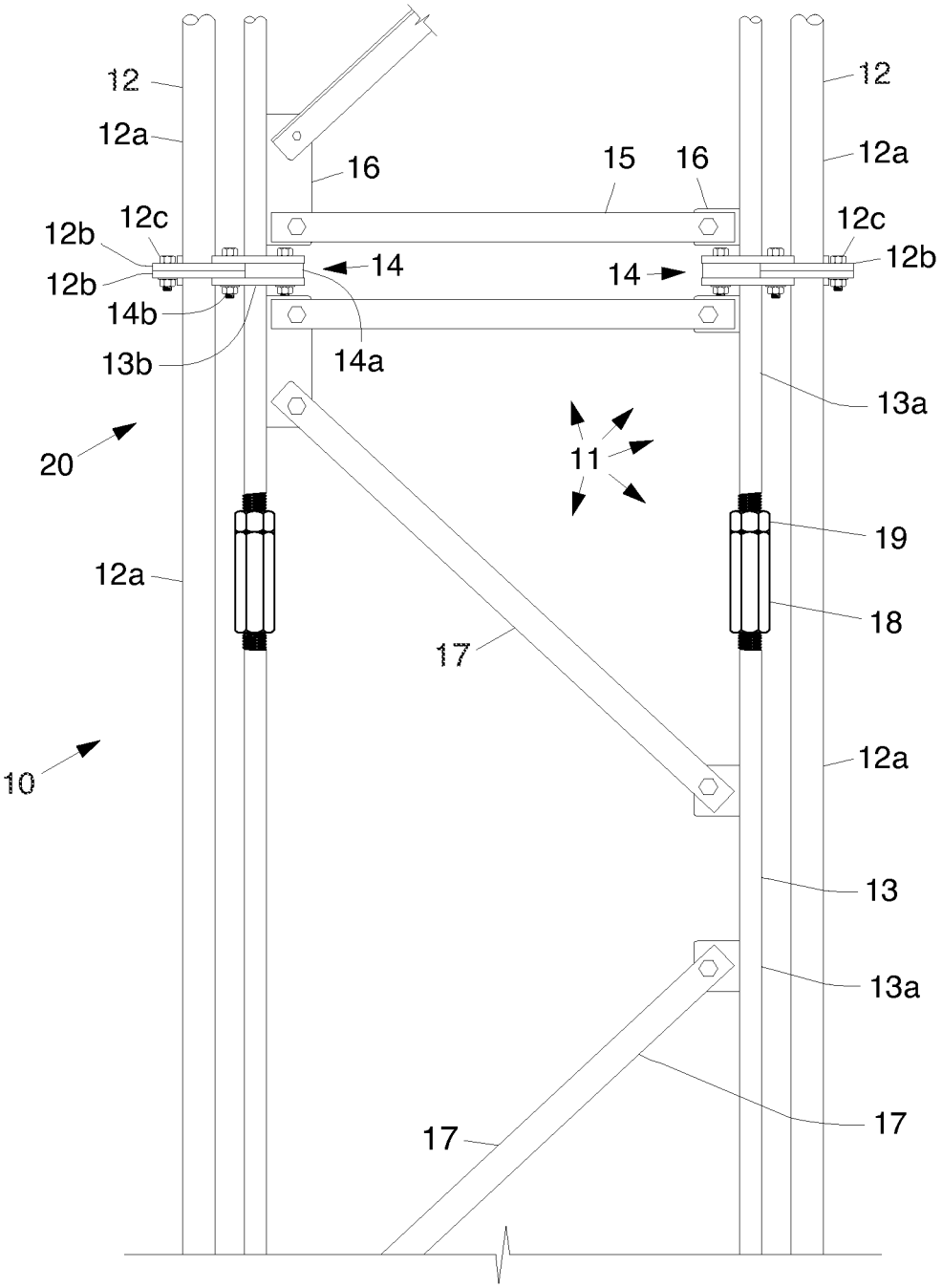
FIG. 2 is an enlarged side view of a portion of a tower and reinforcement apparatus shown in FIG. 1.
Figure 3:
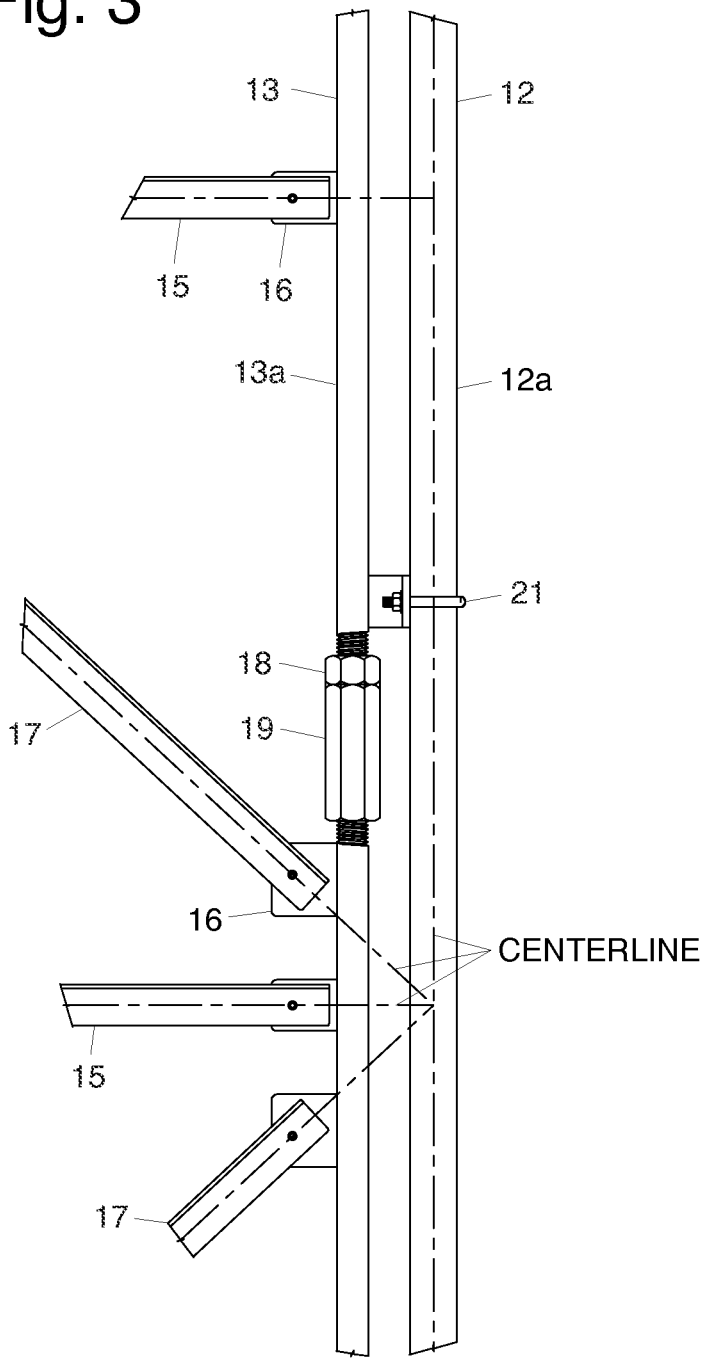
FIG. 3 is an enlarged view of a portion of a tower and reinforcement apparatus encircled in FIG. 1.

Referring to FIG. 1, it shows a front view of an exemplary tower assembly 10 having improved reinforcing and load-bearing apparatus 11 connected thereto. FIG. 2 is an enlarged side view of a portion of a tower assembly 10 and reinforcement apparatus 20 shown in FIG. 1. FIG. 3 is an enlarged view of a portion of the tower assembly 10 and reinforcement apparatus 20 encircled in FIG. 1. The reinforcing and load-bearing apparatus 11 reinforces tower load-bearing members comprising the existing exterior leg members 12 of the tower assembly 10. Individual load-bearing sections of the tower 10 corresponding to sections of the exterior leg members 12 are reinforced by installing reinforcing structures 20 adjacent to the load-bearing sections of the tower assembly 10 inside of the existing tower structure.

Two existing exterior leg members 12 of the tower assembly 10 are shown in FIG. 1 without any connected supporting structure. An interior load-bearing structure 20 comprising the reinforcing and load-bearing apparatus 11 is shown assembled and attached to the two existing exterior leg members 12. The interior load-bearing structure 20 comprises two interior adjustable-length leg members 13 which are aligned substantially parallel to the exterior leg members 12 and the plurality of brace members 15, 17.

Figure 4:
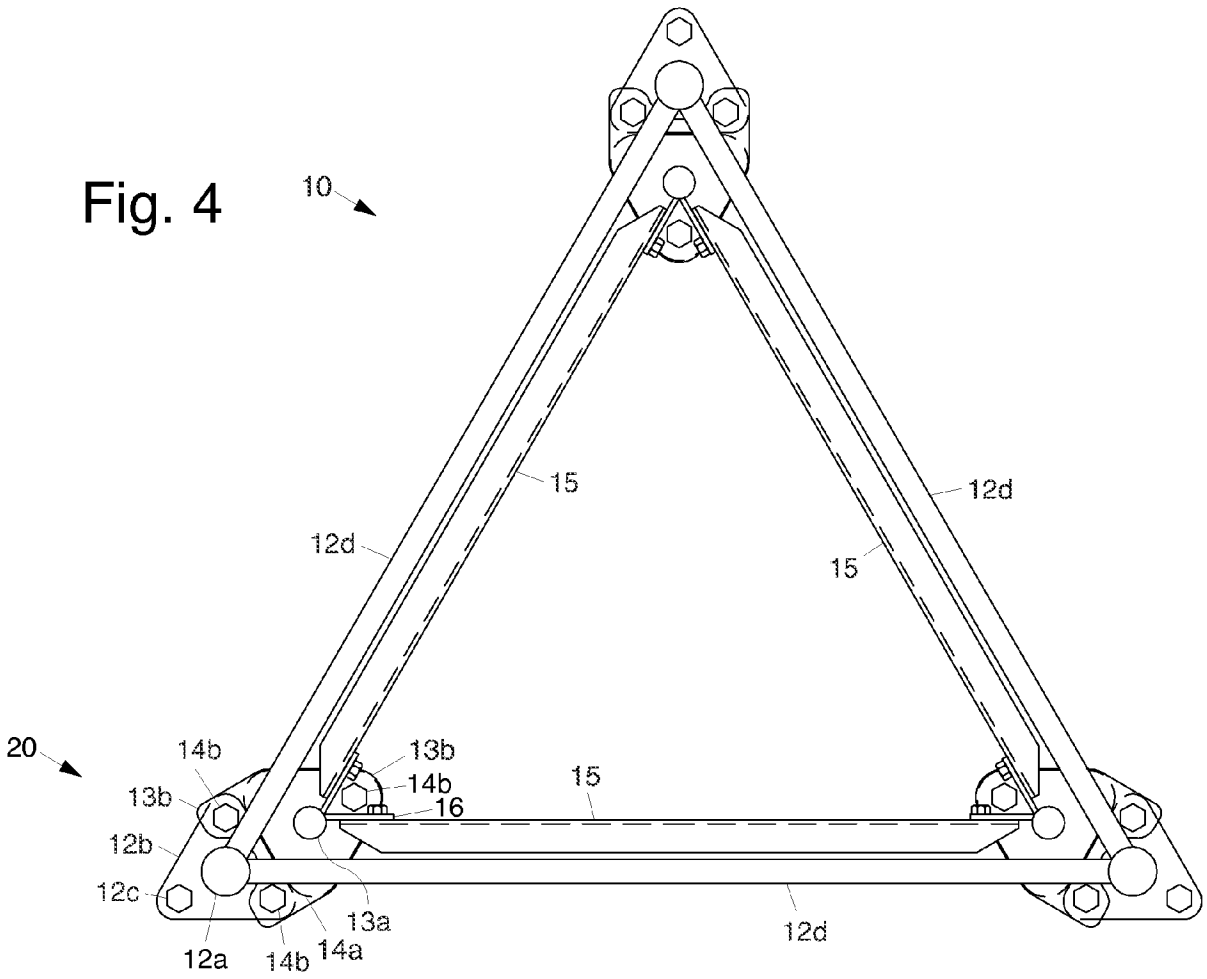
FIG. 4 is a cross-sectional view of the tower and reinforcement apparatus shown in FIG. 1 taken along lines 4-4 in FIG. 1.

FIG. 4 shows a cross sectional view of the exemplary tower assembly 10 shown in FIG. 1, taken along the lines 4-4, illustrating a three-sided guyed tower assembly 10 having three interior load-bearing structures 20. FIG. 4 shows a vertical cross section of the antenna tower 10 illustrating its coaxial structure when the reinforcing structures 20 are assembled and connected to the exterior leg members 12.

In the embodiment of the tower assembly 10 shown in FIGS. 1 and 2, the horizontal and non-horizontal (diagonal) brace members 15, 17 lie in a generally vertical plane so as to connect and strengthen the load-bearing structures 20. Corresponding braces interconnecting the existing leg members 12 of the tower assembly 10 are not shown. FIG. 1 shows a typical tower section length which is usually about 20 feet in length. The length of the attached interior adjustable-length leg members 13 is typically increased in the range of about 0.08 inches to about 0.20 inches, and is typically about 0.14 inches.

The structures 20 shown in FIGS. 1 and 2 are trussed tower strengthening structures. As a result of the horizontal and non-horizontal (diagonal) brace members 15, 17, lateral, compressive and tensile support is provided to the interior adjustable-length leg members 13, and thus to the existing exterior leg members 12 because of the attachment of the interior leg members 13 to the existing exterior leg members 12.

A portion of the compression load on the exterior leg members 12 is transferred to the structures 20, and particularly the interior adjustable-length leg members 13, using intermediate threaded members comprising the threaded sleeve nuts 18 and opposing locking nuts 19, which threadably receive and connect proximal ends of adjacent leg section 13*a*. Rotation of the sleeve nut 18 enables adjustment of the overall length of the associated interior leg member 13 by forcing adjacent leg sections 13*a* apart or bringing them together, depending upon the direction that sleeve nut 18 is rotated. The locking nuts 19 prevent subsequent changes in the threaded position of the sleeve nut 18 relative to the leg sections 13*a* after the desired overall length of the interior leg member 13 is achieved. Once the structures 20 assembled and attached to the exterior leg members 12 using the connection members 14, the sleeve nuts 18 are rotated to lengthen the respective interior adjustable-length leg members 13, thereby transferring a portion of the compression load onto each interior adjustable-length leg member 13. This is operative to shift the predetermined compression load toward the axial centerline of the tower assembly 10. Additional structures 20 are secured to the exterior leg members 12 and adjusted as described until a desired length of the tower assembly 10 is reinforced.

A number of advantages are provided by the apparatus 11 and methods disclosed herein. More wind shielding for the added reinforcing structures 20 results from interior placement of the interior adjustable-length leg members 13 and other components of the structures 20 rather than the exterior placement of new reinforcing members. The tower assembly 10 is safer for tower climbers since original safety line attachments remaining in place. Furthermore, there are fewer reinforcing components that need to be fabricate and installed.

FIG. 4 illustrates a cross-sectional view of the tower assembly 10 taken along lines 4-4 in FIG. 1. FIG. 4 shows three reinforcing structures 20 added to the interior of the tower assembly 10. Three structures 20 are attached to respective sections of the tower assembly 10. The three reinforcing structures 20 are positioned inside the existing leg members 12 located on the outside of the tower assembly 10 and prior to attachment thereto. The transfer of load from the exterior legs 13 of the tower assembly 10 to the three interior structures 20 is accomplished once the interior structures 20 are positioned, attached to the exterior leg members 12, and the lengths of the interior adjustable-length leg members 13 are adjusted.

Figure 5:
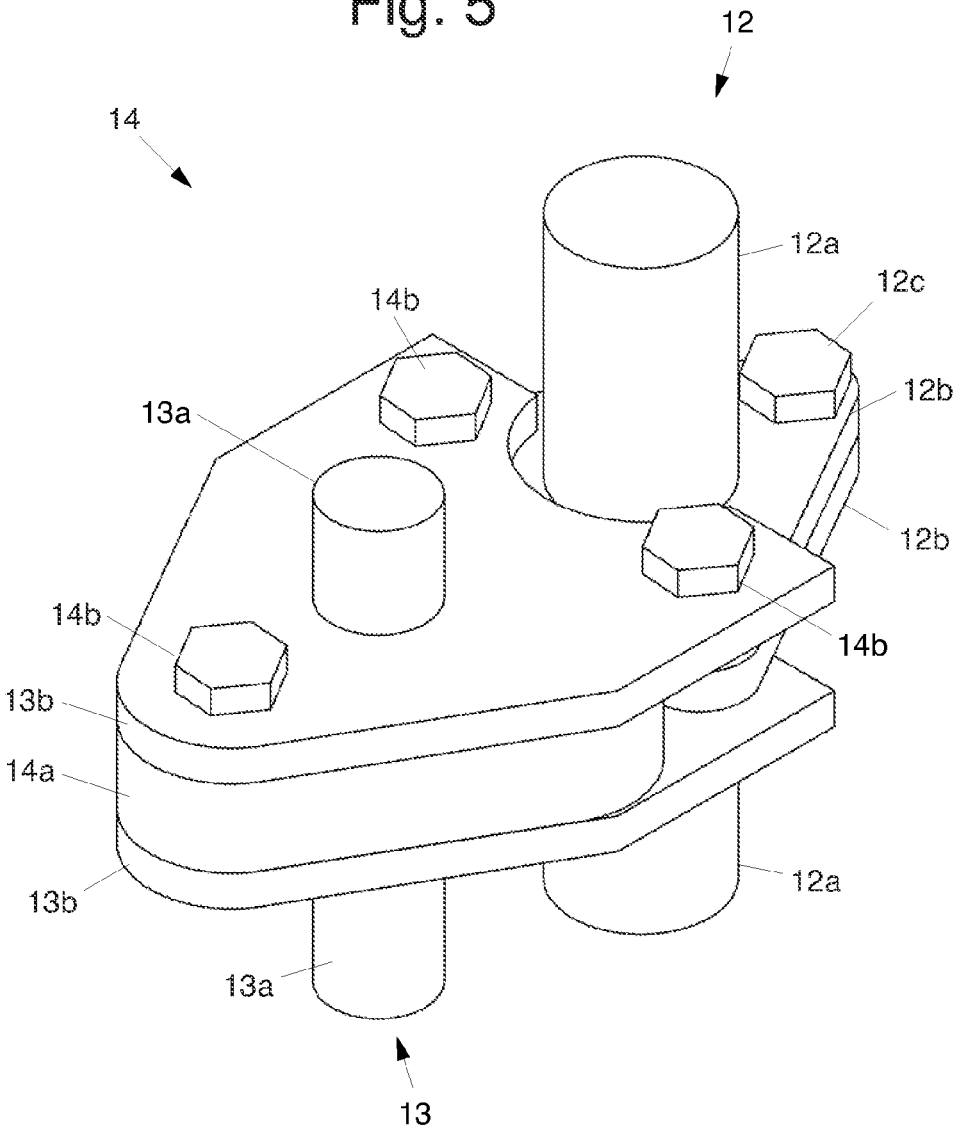
FIG. 5 is an enlarged isometric view of a connection member used in the reinforcement apparatus shown in FIG. 1.

FIG. 5 is an enlarged isometric view of the connection member 14 used in the reinforcement apparatus 10 shown in FIG. 1. The connection member 14 connects the section 13*a* of the interior leg member 13 to the adjacent exterior leg section 12*a*. The two axially abutting exterior leg sections 12*a* have triangular, square or rectangular flanges 12*b* welded to their ends that each have plurality of bolt holes therein adjacent the vertices that have a plurality of bolts 12*c* therein that secure the abutting exterior leg section 12*a* together. A number of the inner bolts 12*c* are removed. Two interior leg sections 13*a* are vertically aligned with their respective flanges 13*b* adjacent one another. A spacer 14*a* is placed between the flanges 13*b* so that it abuts adjacent edges of the flanges 12*b* and respective holes in the flanges 13*b* are aligned with the inner holes in the flanges 12*b* and the hole in the spacer 14*a*. A number of bolts 14*b* are inserted through the holes in the aligned flanges 13*b*, spacer 14*a* and flanges 12*b* and secured by nuts.

Figure 6:
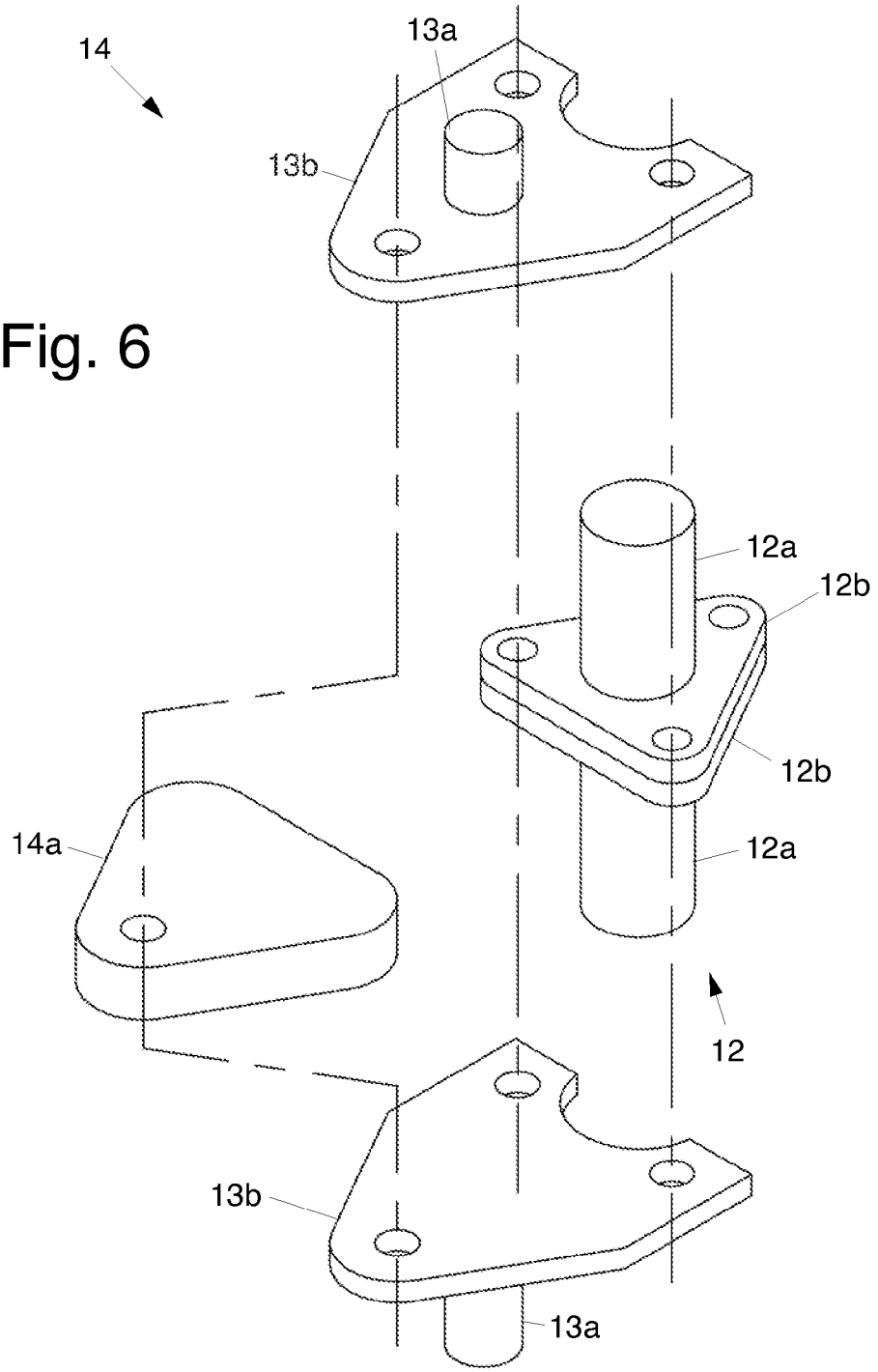
FIG. 6 is an exploded isometric view of a connection member shown in FIG. 5.

FIG. 6 is an exploded isometric view of the connection member 14 shown in FIG. 5. FIG. 6 shows how the holes are aligned during assembly of the connection member 14.

Figure 7:
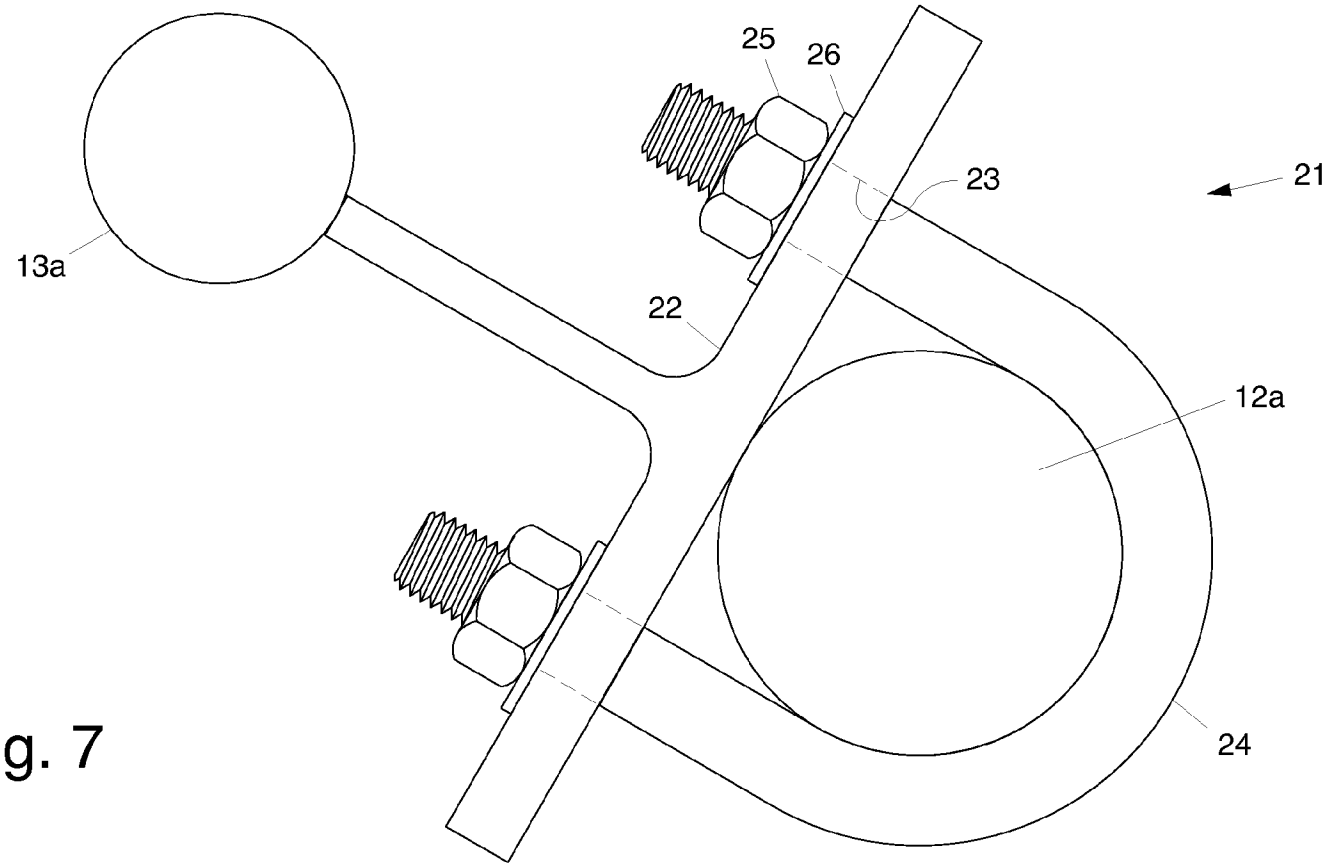
FIG. 7 illustrates an exemplary U-bolt that may be used in the reinforcement apparatus shown in FIG. 1.

FIG. 7 illustrates a cross-sectional view of the tower assembly 10 taken along lines 7-7 in FIG. 1. FIG. 7 shows exemplary intermediate connection apparatus 21 that may be used in the reinforcement apparatus shown in FIG. 1. The exemplary intermediate connection apparatus 21 comprises U-bolt connection apparatus 21 that is welded or otherwise attached to a sections 13*a* of an interior adjustable-length leg member 13. The welded structure is configured as a T-shaped flange 22 with two holes 23 disposed in it that accept a U-bolt 24. Once the interior adjustable-length leg member 13 is positioned and attached using the connection member 14, the U-bolt 24 is positioned around the exterior leg section 12*a* an inserted through the holes 23 in the flange 22 and secured using two washers 26 and nuts 25

Components of the reinforcing structures 20 are preferably attached using bolted connections, but other types of connections may be appropriate depending on the design of the tower assembly 10 that is to be reinforced. Installation of the reinforcing apparatus 10 requires no attachment to or augmentation of existing diagonal and/or horizontal braces of the existing tower assembly 10 and does not require welding to and/or drilling through any existing structure.

The interior adjustable-length leg members 13 and brace members 15, 17 may be fabricated using any material capable of providing the requisite support. Preferably, they are made of a suitable metal or metal alloy with a cross-section which may be solid or hollow, round or polygonal, or any shape that is deemed appropriate for providing the desired level of loading support.

The present invention also provides for methods of reinforcing one or more load-bearing sections of an existing tower assembly 10 having a plurality of exterior leg members 12, which load-bearing sections each support a predetermined compression load.

An exemplary method comprises attaching a plurality of interior adjustable-length leg members 13 to respective ones the plurality of exterior leg members 12 at predetermined locations along a vertical dimension of the tower assembly 10 so that the interior adjustable-length leg members 13 are closer to an axial centerline of the tower assembly 10 than the exterior leg members 12. The interior adjustable-length leg members 13 are lengthened to transfer a portion of the compression load from the exterior leg members 12 to the interior adjustable-length leg members 13 and shift the predetermined compression load toward the axial centerline of the tower assembly 10 and onto the interior adjustable-length leg members 13. The two lengthened interior adjustable-length leg members are interconnected using one or more brace members 15, 17. The lengthened interior adjustable-length leg members 13 are interconnected to the exterior leg members 12 at intermediate locations between the predetermined locations by the lateral support clamp 21.

Thus, exemplary apparatus and methods for reinforcing tower structures have been disclosed. It is to be understood that the above-described embodiments are merely illustrative of some of the many specific embodiments that represent applications of the principles of the present invention. Clearly, numerous and other arrangements can be readily devised by those skilled in the art without departing from the scope of the invention.

What is claimed is:

1. Apparatus for reinforcing a load-bearing section of an existing tower assembly having a plurality of exterior leg members, which load-bearing section supports a predetermined compression load, the apparatus comprising:

a plurality of interior adjustable-length leg members for attachment to corresponding adjacent exterior leg members at locations closer to an axial centerline of the tower assembly than the exterior leg members;

a plurality of lateral brace members interconnecting horizontally adjacent ones of the plurality of interior leg members; and a plurality of connection members for individually attaching each interior adjustable-length leg member to a corresponding adjacent one of the exterior leg members;

wherein the plurality of interior adjustable-length leg members are adjustable in length so as to lengthen the interior adjustable-length leg members and transfer a portion of the compression load from the exterior leg members onto the interior adjustable-length leg members and shift the predetermined compression load toward the axial centerline of the tower assembly.

2. The apparatus recited in claim 1 wherein the plurality of lateral brace members comprise horizontal brace members and non-horizontal brace members.

3. The apparatus recited in claim 1 wherein each interior adjustable-length leg member comprises an intermediate threaded member that threadably receives and connects adjacent interior leg sections, which intermediate threaded member is rotatable to adjust the length of the interior adjustable-length leg member.

4. The apparatus recited in claim 3 wherein the existing tower assembly comprises a plurality of existing brace members, and wherein interior brace members are laterally coplanar with respect to adjacent ones of the existing brace members to provide shielding from wind forces exerted on the tower assembly and minimize the exposed area of the reinforcing structure that is affected by wind.

5. A method for reinforcing one or more load-bearing sections of an existing tower assembly having a plurality of exterior leg members, which load-bearing sections each support a predetermined compression load, which method comprises:

(1) attaching a plurality of interior adjustable-length leg members to respective ones the plurality of exterior leg members at predetermined locations along a vertical dimension of the tower assembly so that the interior adjustable-length leg members are closer to an axial centerline of the tower assembly than the exterior leg members;

(2) lengthening the interior adjustable-length leg members to transfer a portion of the compression load from the exterior leg members to the interior adjustable-length leg members and shift the predetermined compression load toward the axial centerline of the tower assembly and onto the interior adjustable-length leg members;

(3) interconnecting pairs of horizontally adjacent lengthened interior adjustable-length leg members using one or more lateral brace members; and (4) interconnecting the lengthened interior adjustable-length leg members to the exterior leg members at intermediate locations between the predetermined locations.

6. The method recited in claim 5 wherein each of the plurality of interior adjustable-length leg members comprise adjacent leg sections having flanges at their respective adjacent ends that abut and are secured to a spacer disposed between the flanges and are secured to the exterior leg members.

7. The method recited in claim 5 wherein the interior adjustable-length leg members comprise solid round leg members.

8. The method recited in claim 5 wherein lengthening the interior adjustable-length leg members comprises rotating an intermediate threaded member that threadably receives and connects adjacent interior leg sections to reduce the compression load on the exterior leg members and shift the predetermined compression load toward an axial centerline of the tower assembly.

9. The method recited in claim 5 wherein the intermediate threaded members comprises sleeve nuts and associated locking nuts.

10. The method recited in claim 5 wherein the existing tower assembly comprises a plurality of existing brace members, and wherein the method comprises:

attaching the interior brace members in a laterally coplanar fashion with respect to adjacent ones the existing brace members to provide shielding from wind forces exerted on the tower assembly and minimize the exposed area of the reinforcing structure.

11. Apparatus for reinforcing a load-bearing section of an existing triangular tower assembly having three exterior leg members, which load-bearing section supports a predetermined compression load, the apparatus comprising:

three interior adjustable-length leg members for attachment to corresponding adjacent exterior leg members at locations closer to an axial centerline of the tower assembly than the exterior leg members to form an interior triangular load-bearing structure;

a plurality of lateral brace members interconnecting horizontally adjacent ones of the three interior leg members; and a plurality of connection members for individually attaching each interior adjustable-length leg member to a corresponding adjacent one of the exterior leg members;

wherein the three interior adjustable-length leg members are adjustable in length so as to lengthen the interior adjustable-length leg members and transfer a portion of the compression load from the exterior leg members onto the interior adjustable-length leg members and shift the predetermined compression load toward the axial centerline of the tower assembly.

12. The apparatus recited in claim 11 wherein the interior adjustable-length leg members comprise sleeve nuts and locking nuts and each interior adjustable-length leg member comprises an intermediate threaded member that threadably receives and connects adjacent interior leg sections, which intermediate threaded member is rotatable to adjust the length of the interior adjustable-length leg member.

13. The apparatus recited in claim 11 wherein the plurality of brace members comprise horizontal brace members and non-horizontal brace members.

14. The apparatus recited in claim 11 wherein the interior adjustable-length leg members comprise splice connection members and locking members.

15. The apparatus recited in claim 11 wherein splice connection members and locking members comprise sleeve nuts and locking nuts.

* * * * *